US005647071A

United States Patent [19]

Suzuki et al.

[11] Patent Number: 5,647,071

[45] Date of Patent: Jul. 15, 1997

[54] BATHING APPARATUS

[75] Inventors: Hajime Suzuki, Kamagaya; Yasuo Sekiguchi, Matsudo, both of Japan

[73] Assignee: Sakai Medical Co., Ltd., Tokyo, Japan

[21] Appl. No.: 416,305

[22] Filed: Apr. 4, 1995

[30] Foreign Application Priority Data

Apr. 6, 1994 [JP] Japan ..... 6-068821
Nov. 11, 1994 [JP] Japan ..... 6-278161

[51] Int. Cl.[6] ..... A47K 3/12; A47K 3/022

[52] U.S. Cl. ..... 4/555; 4/556; 4/604

[58] Field of Search ..... 4/555, 556, 559, 4/560.1, 561.1, 562.1, 604

[56] References Cited

U.S. PATENT DOCUMENTS

| | | | |
|---|---|---|---|
| 1,683,430 | 9/1928 | Wright | 4/555 |
| 2,888,683 | 6/1959 | Medlock | 4/604 |
| 3,703,733 | 11/1972 | McLoughlin . | |
| 4,432,104 | 2/1984 | Sasaki | 4/560.1 |
| 4,523,341 | 6/1985 | Queen | 4/555 |
| 4,796,312 | 1/1989 | Corlew | 4/555 |

FOREIGN PATENT DOCUMENTS

| | | |
|---|---|---|
| 515019 | 12/1971 | Germany . |
| 3026221 | 2/1991 | Japan . |
| 1135196 | 12/1968 | United Kingdom . |
| 1582900 | 1/1981 | United Kingdom . |
| 2228673 | 9/1990 | United Kingdom . |

*Primary Examiner*—Henry J. Recla
*Assistant Examiner*—Charles R. Eloshway
*Attorney, Agent, or Firm*—Dilworth & Barrese

[57] ABSTRACT

A bathing apparatus for disabled and aged which allows bathing of a person in a seated position in a wheel chair. The bathing apparatus is hygienic because the caster rollers for the wheel chair are isolated from the bath water in a non-water-filled section of the apparatus thus avoiding contamination of the bath water, and can be operated with ease with one helper person. The bathing apparatus requires less water for a full bath compared with the conventional wheel chair bathing units, because the chair frames are designed to ride on the inside of the bath tub. This configuration is made possible by having a chair frame supported on a single support rod which can be pushed inside the bath tub through a cut-out provided on the bottom section of the tub unit. The support rod emerging from the bottom section into the bath water is sealed by a pair of sealing members which are pressed tightly around the support rod to eliminate leaking of the bath water from the tub unit.

14 Claims, 15 Drawing Sheets

BATHING APPARATUS

BACKGROUND OF THE INVENTION

1. Field of the Invention

The present invention relates to a bathing apparatus that combines a wheel chair with a door-equipped bathing tub to enable a disabled or aged person to take hygienic bathing in a sitting position on the wheel chair.

2. Technical Background

Regular bath tubs are open-top box type units, making it difficult for a physically disabled or aged to bathe because it is necessary for the bather to step over a side wall to get inside the bath tub.

To make it easier for the physically disabled or the aged to take a bath, a door-equipped bathing unit described below has been developed which combines a wheel chair and a bath tub having an openable door.

In the bathing unit, a bather sits on a wheel chair which is pushed by a helper along a sloped pathway leading to an open side door of the bathing unit. The helper positions the wheel chair suitably inside the bath tub, and the side door is closed water tight, and the tub is filled with warm water, thus enabling to provide bathing while the bather is seated in the wheel chair.

This type of bathing arrangement presented the following problems.

(1) The arrangement requires that the wheel chair with the bather is transported into the tub by travelling over the sloped pathway, and therefore the caster rollers which have rolled over the floors of the hallway and the bathing room are also placed inside the bath water. This presents a hygienic problem of contaminating the bath water.

(2) After the bathing is over, the wheel chair with the bather must be pushed up the inclined pathway, and because of the free wheeling caster rollers and wetness of the rollers, it is difficult for one helper person to push up the wheel chair in a straight line. This presents a problem that more than one helper person is required to handle the bather.

(3) The bather takes a bath while sitting on the wheel chair, and therefore, the warm water level for a full bath (immersion to the shoulder level) includes the height of the casters. This means that some needless amount of warm water is being used, because of the presence of the casters in the bath water.

(4) It is not possible to open and close the side door while the sloped pathway is in its loading/unloading position, because of the mechanical interference of the door bottom with the inclined pathway. Therefore, for each opening or closing of the door for a bathing occasion, the pathway must be separated away or lowered from the tub. This presents a problem that the bathing operation is cumbersome.

SUMMARY OF THE PRESENT INVENTION

The present invention relates to a door-equipped bathing unit to resolve the problems encountered in the existing system of bathing units for physically disabled or aged. The objective of the present invention is to present a bathing apparatus which permits the bather to bathe while being seated in a wheel chair yet presents no problem of poor hygiene, permits easier loading/unloading of the wheel chair in and out of the bath tub than the conventional wheel chairs, and permits a bather to take a full bath while using less warm water than that required for the conventional door-equipped bathing units.

The objective is achieved in a door-equipped bathing apparatus comprising: a wheel chair provided with a chair base having caster rollers, a support rod fixedly erected on said chair base, and a seat section firmly supported on a free end of said support rod; and a bath tub provided with a bottom section having a bottom sealing device for providing water-tight sealing around said support rod which passes through said bottom section of said bath tub; wherein an opening section formed on a vertical section of said bath tub provides entry of said wheel chair through said opening section into a tub member of said door-equipped bathing apparatus.

According to the bathing apparatus of the above construction, a bather is placed on a wheel chair which is wheeled inside the bath tub, whose door has been preopened, on caster wheels. The wheel chair is wheeled into the bath tub steadily by being guided by the support rod confined in the cut-out section provided on the bottom section of the bath tub. The wheel chair is positioned suitably inside the bath tub, and the bottom sealing members are closed tight against each other to provide a water-tight tub member. The door member is closed against the tub member, and door seals are set in place to seal the tub member. Warm water can now be filled into the tub member for the bather to take a full bath. Because the caster wheels are isolated from the bath water by being located below the bottom section of the bath tub which is devoid of water, the bath water is kept hygienic and free from any risk of contamination. By eliminating the sloping pathway leading to the bath tub, the wheel chair is easily handled by one person because the wheel chair only needs to be transported on a flat floor of the bath room. Because there is no need to immerse the caster rollers in bath water, there is less water needed than in the conventional bathing units. The overall effect of the present invention is an effective and economical bathing apparatus for disabled or aged.

PREFERRED EMBODIMENTS OF THE INVENTION

The present invention will be described with reference to the accompanying drawings.

Figure 1:
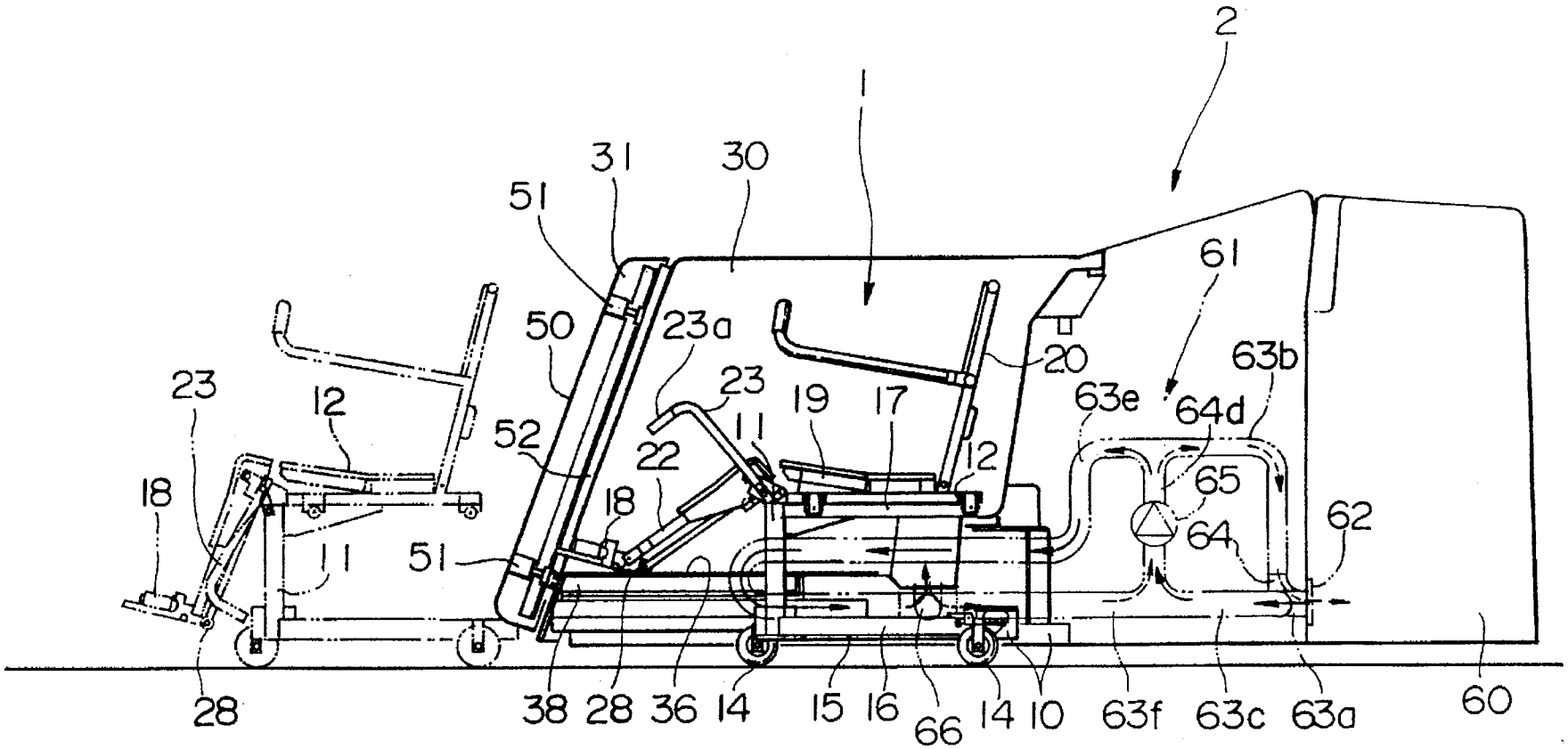
FIG. 1 is a cross sectional side view of a first embodiment of the bathing apparatus of the present invention.
Figure 2:
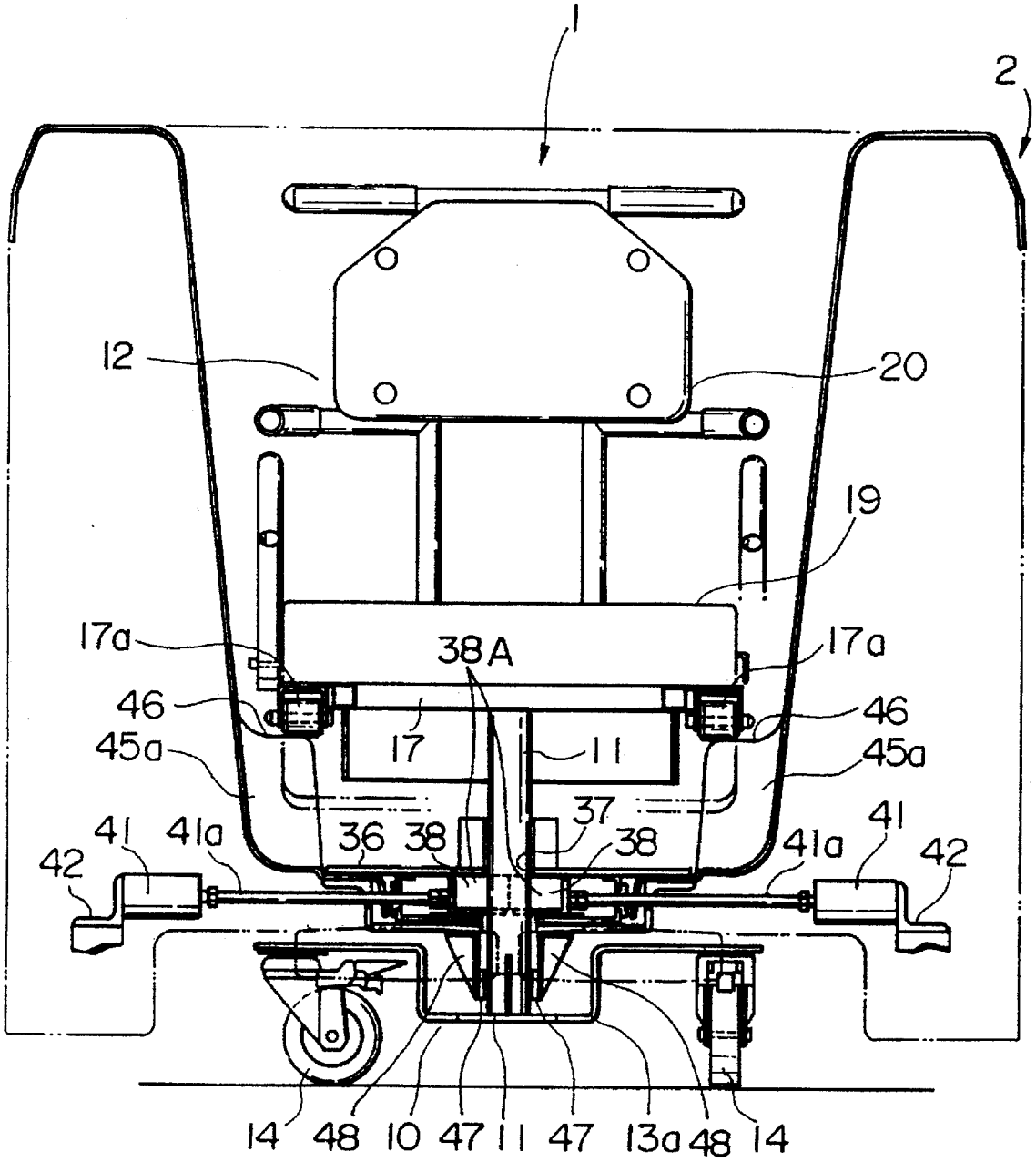
FIG. 2 is a cross sectional front view of the bathing apparatus of the first embodiment.
Figure 3:
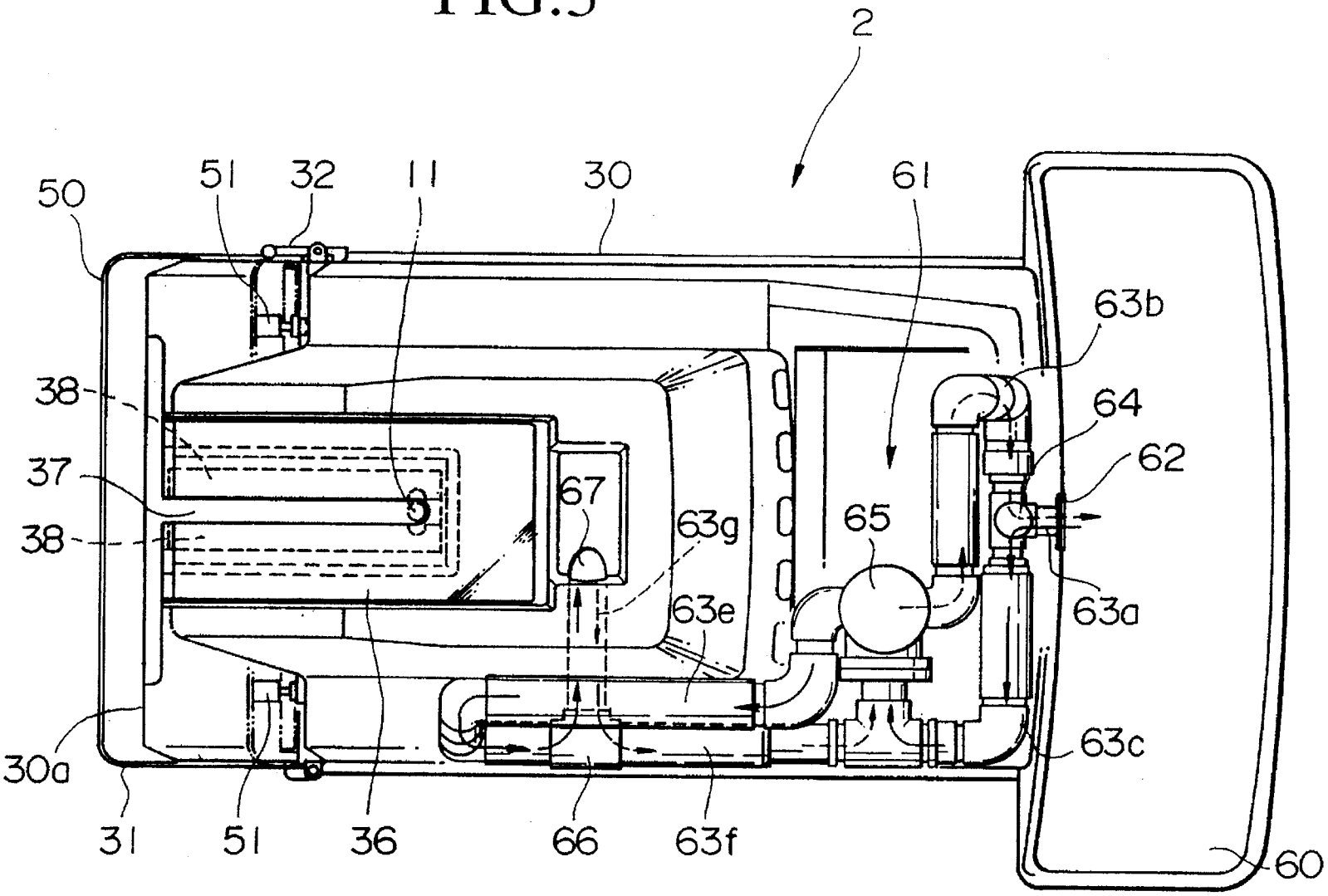
FIG. 3 is a cross sectional plan view of the bathing apparatus of the first embodiment.

FIGS. 1 to 10 relate to a first embodiment. FIG. 1 is a cross sectional side view, FIG. 2 is a cross sectional front view and FIG. 3 is a cross sectional plan view, respectively, of the bathing apparatus.

As shown in these drawings, the bathing apparatus of the present invention comprises a wheel chair 1 for seating a bather and a door-equipped bath tub 2 which permits the wheel chair with the bather to be positioned inside the bath tub 2 to be filled with warm water for bathing.

Figure 4:
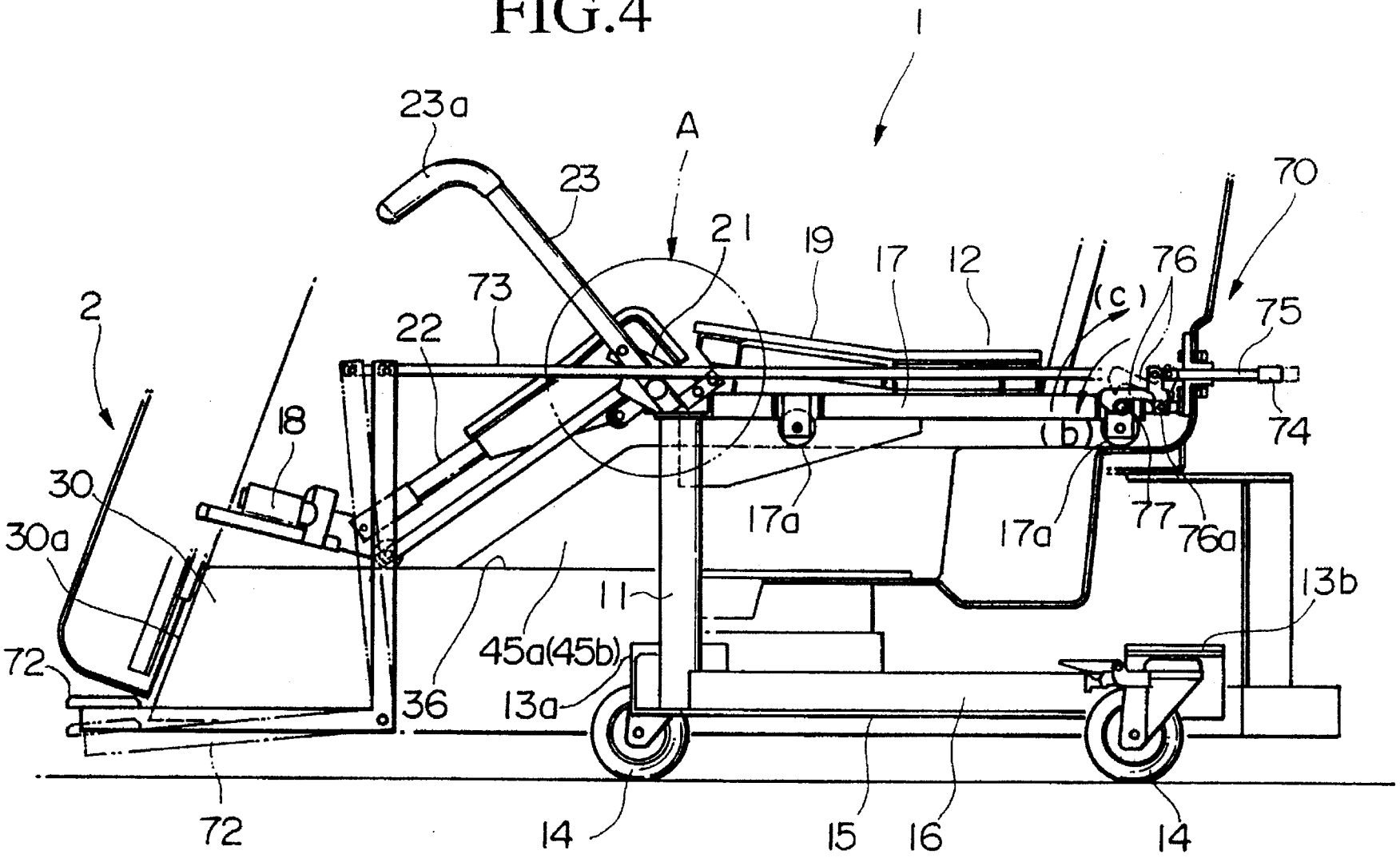
FIG. 4 is a side view showing the details of the wheel chair.

The wheel chair 1 will be described first. As shown in FIG. 4 also, the wheel chair 1 comprises a chair base 10 having caster rollers 14, a support rod 11 attached to the chair base 10 and a seat section 12 supported by the top end of the support rod 11.

As shown in FIG. 2 also, the chair base 10 comprises: front and back plate sections 13*a*, 13*b* having caster rollers 14 attached to the lower section of both plate sections 13*a*, 13*b*; a connecting plate member 15 which joins a depression disposed on the center of each plate section 13*a*, 13*b*; and a reinforcing pipe 16 of a square cross sectional shape disposed on top of the connecting member 15 for reinforcing the connecting plate member 15. In the center of the front plate member 13*a*, there is fixedly erected the single support rod 11.

The seat section 12 which is attached to the top end of the support rod 11 includes a chair frame 17 having chair frame rollers 17*a* on the bottom section of the chair frame 17. The chair frame 17 comprises, from the front to the back, a foot rest 18, a seat member 19 and a back-rest member 20.

Figure 5:
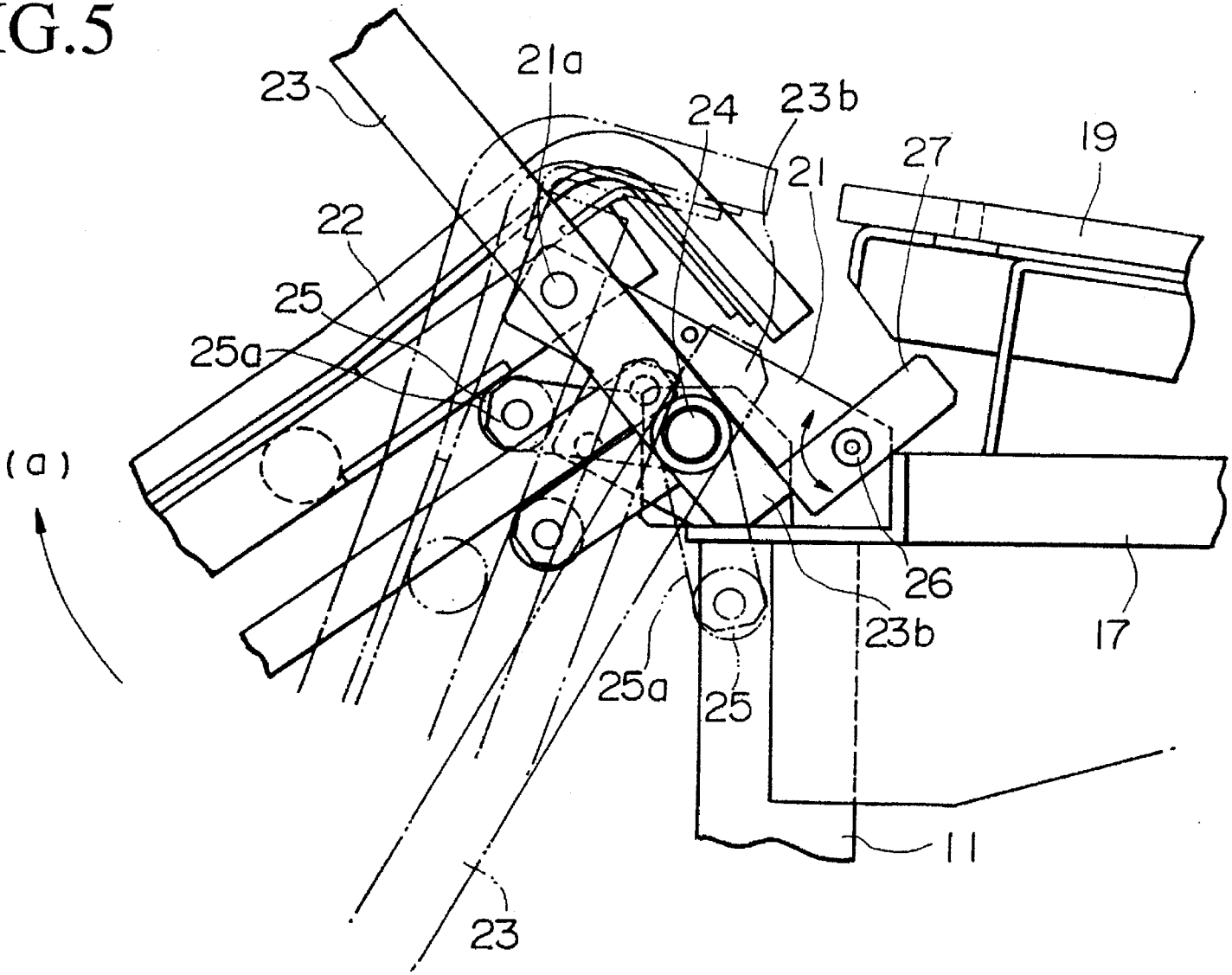
FIG. 5 is an enlarged side view of the structure in circle A in FIG. 4.

The foot rest 18, as shown in FIG. 5, is supported by the bottom end of a foot rest support rod 22 freely rotatably supported on a shaft 21*a* held by a pair of brackets 21 attached to the left and right sides of the chair frame 17. The bracket 21 is provided with a freely rotatable arm 23 having a grip section 23*a* for a helper to transport the arm chair 1 (refer to FIG. 4). The arm 23 attached to the bracket 21 is supported by an axle 24 which is provided with rollers 25 by way of a link 25*a*, and the arm 23, axle 23*a* and the rollers 25 rotate as a unit. This configuration allows the foot rest 18 to be locked in position when the helper moves the wheel chair 1 in the clockwise direction "a", shown in FIG. 5, by holding onto the grip section 23*a*. This locking action is performed by the rollers 25 rotating as a unit with the arm 23 contacting the bottom surface of the foot rest support rod 22, and rotating the foot rest support rod 22 about the axle 21*a*, thus forcing the foot rest 18 to rotate to a certain angle shown in FIGS. 1 and 5 with a solid line, and locking the foot rest 18 in this position. The locking action is provided by the opposite end of the grip section 23*a* of the arm 23 engaging with the tip of a locking member 27 biased to rotate in the counter-clockwise direction, in FIG. 5, about an axle 26 with a biasing device (not shown).

In the locked state, the foot rest 18 is limited in its downward rotation (counter clockwise direction in FIG. 1) but is free to rotate upwards (clockwise direction in FIG. 1). To release the foot rest 18 from the locked state, the lever 27 is operated clockwise in FIG. 5 against the biasing device so as to release the engagement of the tip 23*b* of the arm 23.

Also, in the locked state, the height of the foot rest 18 is set so that the roller 28 disposed at the bottom of the foot rest 18 is about the same height as the top surface of the bottom section 36 of the bath tub 2.

The bath tub 2 comprises a door-equipped tub member 30 whose front opens (left side in FIG. 1) and a door unit 31. The door unit 31 is attached to the tub member 30 with hinges, and the door unit 31 is held in the closed position with a door locking device 32 (refer to FIG. 3).

The tub member 30 is placed on the floor of the bath room so that the bottom section 36 of the tub member 30 is roughly horizontal by means of the nuts and bolts fixtures attached to the bottom of the bath tub member frame (not shown).

The bottom section 36 of the tub member 30 is disposed higher than the caster rollers 14 of the wheel chair 1, and its height corresponds to the height of the support rod 11 of the wheel chair 1. As shown in FIG. 3, the bottom section 36 has a cut-out section 37 which extends from the opening section 30*a* of the tub member 30, which forms the mating interface with the door unit 31, towards the back of the bath tub 2. The cut-out section 37 allows the intrusion of the support rod 11 when the wheel chair 1 is positioned in a certain location within the bath tub 2, and therefore, the width dimension of the cut-out section 37 is made slightly larger than the diameter of the support rod 11.

Figure 6:
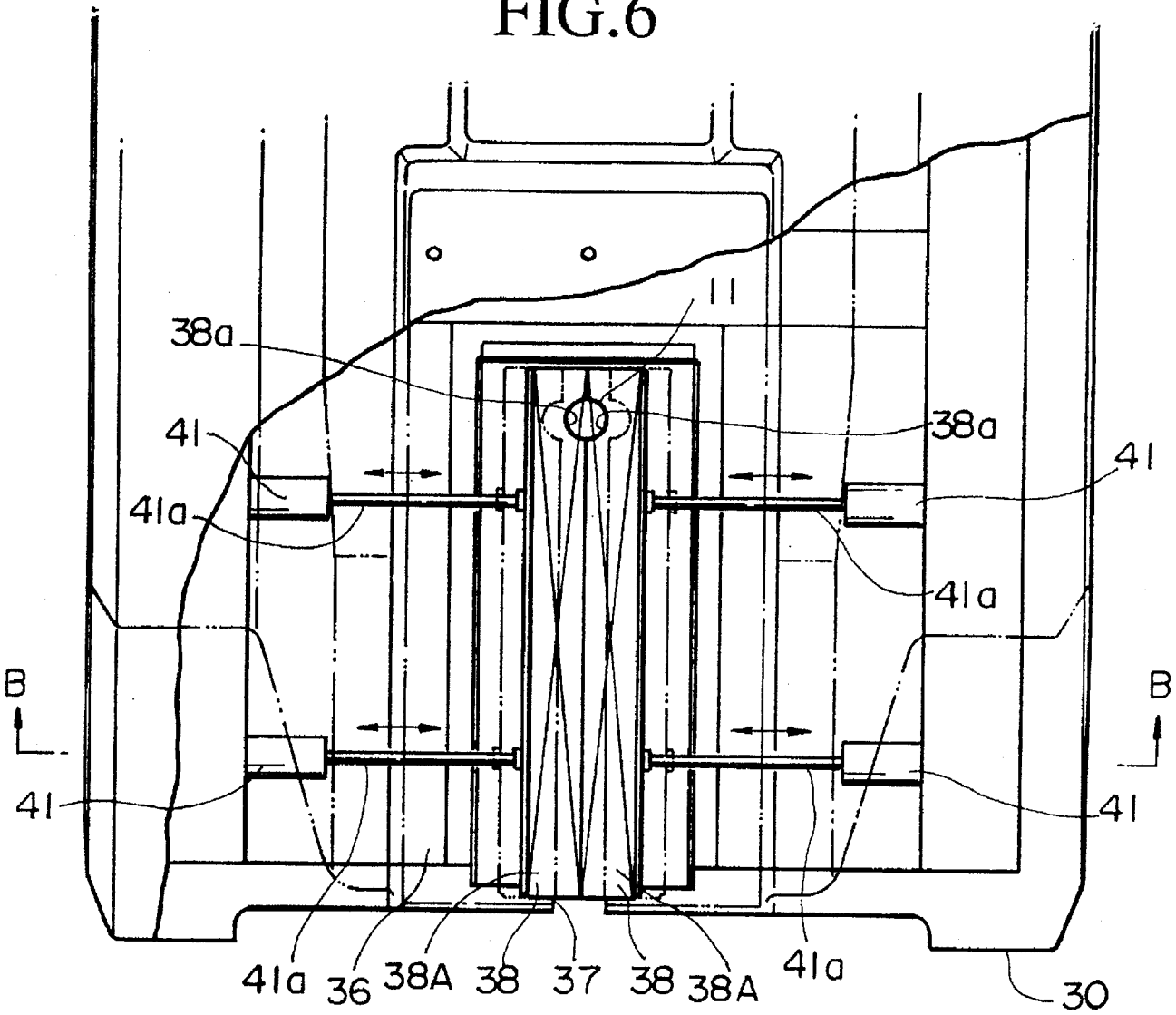
FIG. 6 is an enlarged plan view showing the essential features of a section of the bath tub of the first embodiment.
Figure 7:
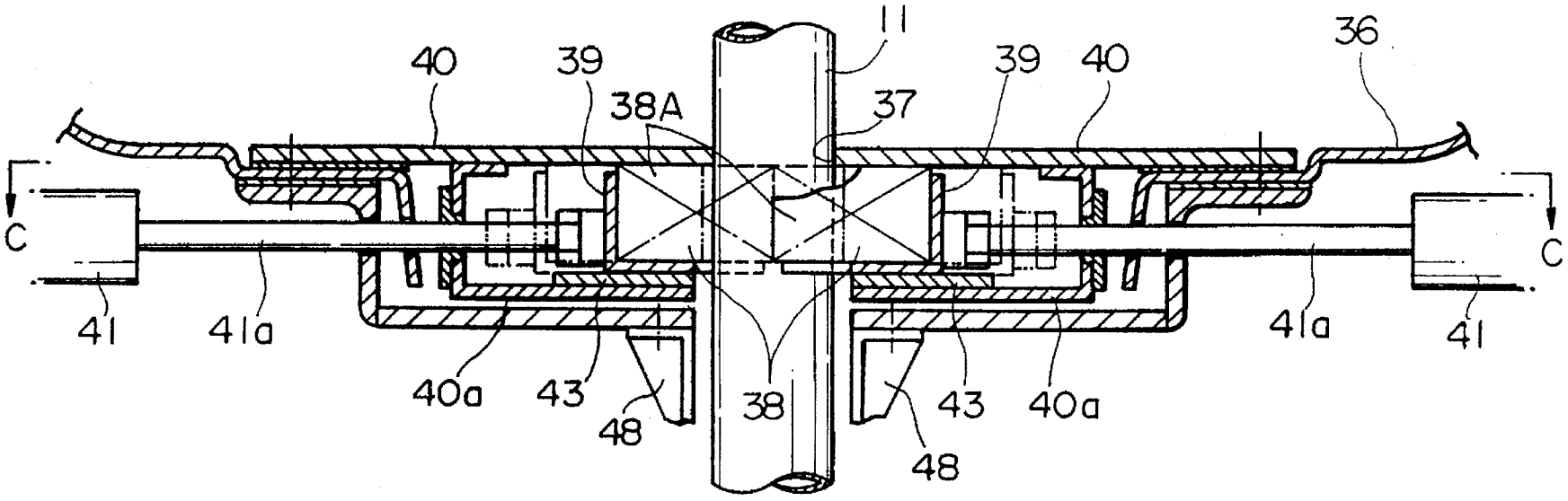
FIG. 7 is a cross sectional view along the line B—B in FIG. 6.

The bottom section 36 is provided with a pair of bottom sealing members 38 which are movable in the left/right directions and surround the support rod 11 from left and right sides, when the wheel chair 1 is disposed inside the tub member 30, so as to seal the cut-out section 37. The bottom sealing members 38 constitute a part of the bottom sealing device 38A (refer to FIG. 6) which provides a water-tight sealing for the bottom section 36 when the support rod 11 is placed in the cut-out section 37. As shown in FIG. 7, the bottom sealing members 38 are disposed between an upper stainless steel plate 40 and a lower support member 40*a* having an L-shaped cross section, both of which are fixed to the bottom section 36 of the tub member 30. The bottom sealing members 38 are provided with reinforcing members 39 of an L-shaped cross section to retain the shape of the bottom sealing members 38. The bottom sealing members 38 are moved left or right by being pressed by way of the reinforcing member 39 by a piston rod 41*a* extending from a hydraulic cylinder 41. There are several cylinders 41 provided for each of the pair of bottom sealing members 38 (two are shown in FIG. 6), and the hydraulic cylinders 41 are supported by the support frame 42 disposed within the tub member 30 (refer to FIG. 2).

The bottom sealing members 38 are made of a pliable but water resistant material to serve the purpose of providing water-tight sealing, for example, sponge-like material having a plurality of independent pores, foamed styrene or rubber. Also, as shown in FIG. 6, each of the side surfaces of the bottom sealing members is provided with a depression section 38*a* having a curvature to correspond with the curvature on the support rod 11 so as to provide a liquid-tight seal around the support rod 11 when the wheel chair 1 is position in place in the tub member 30. In FIG. 7, a sliding member 43 is provided between the reinforcing member 39 and the support member 40*a* to ensure smooth sliding on each other, made of a low friction material such as Teflon (polytetrafluoroethylene).

As shown in FIGS. 2 and 4, there are provided protrusion sections 45*a*, 45*b* protruding towards the interior of the tub member 30 on the inside surface at the mid-height position in the tub member 30. Each of the upper surfaces of the protrusion sections 45*a*, 45*b* are formed with a flat section 46 for sliding support of the chair frame rollers 17*a*. In other words, the protrusion sections 45*a*, 45*b* serve the purpose of permitting the rotational translation of the chair frame rollers 17*a* and of reducing the amount of warm water needed for full bathing.

Also, as seen in FIG. 2, the guide member 47 supported by the bracket 48 is provided below the bottom section 36. The guide member 47 serves the purpose of guiding the wheel chair 1, when the wheel chair 1 is pushed inside the bath tub 2, to avoid the wheel chair wobbling left or right with respect to the bath tub 2 by abutting against the square pipe 16 disposed above the chair base 10 of the wheel chair 1.

Figure 8:
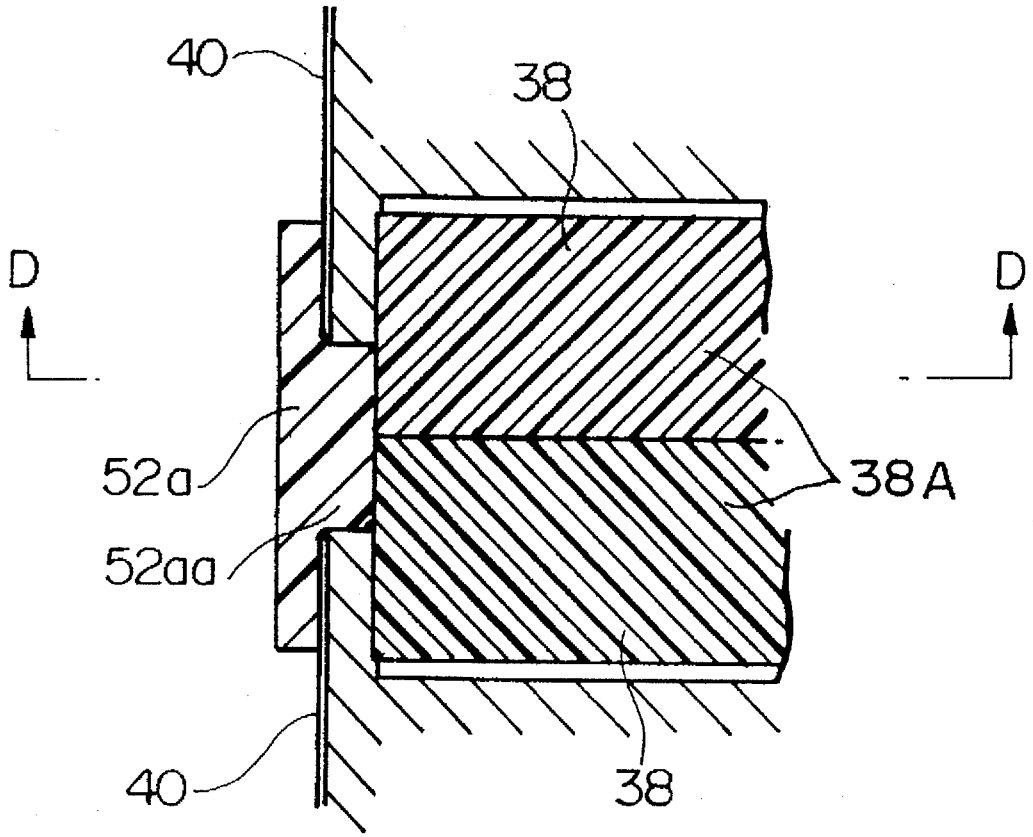
FIG. 8 is a cross sectional view along the line C—C in FIG. 7.
Figure 9:
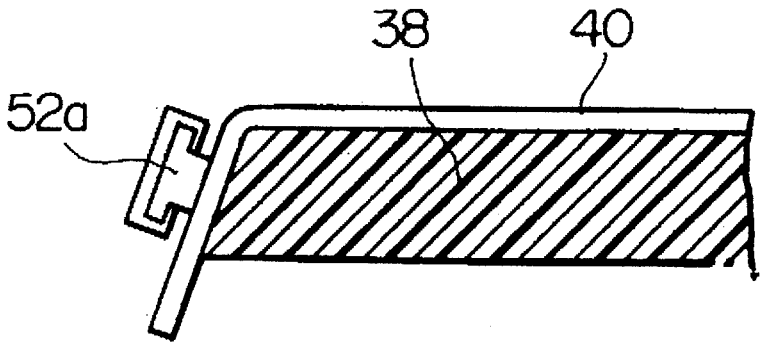
FIG. 9 is a cross sectional view along the line D—D in FIG. 8.

As shown in FIGS. 1 and 3, the door unit 31 comprises a main door member 50 and a sealing plate 52 which is held with a plurality of door cylinders 51 and can be moved towards or away from the main door member 50. The main door member 50 is attached to the tub member 30 by means of a door hinge on one side, and the opposite side is closed on the tub member 30 by engaging the door locking device 32. The sealing plate 52 is provided with a door seal section 52*a* which is pressed tightly against the peripheral edges of the opening section 30*a* of the tub member 30 (refer to FIGS. 8 and 9). The door seal section 52*a* of the door unit 31 is provided with a protruding door sealing part 52*aa*, as shown in FIG. 8, and serves the purpose of sealing the section between the two bottom sealing members 38 of the bottom sealing device 38A provided below the bottom section 36 of the tub member 30 by abutting against the depression formed between the stainless steel plates 40 provided on the bottom section 36 of the tub member 30 when the bottom sealing members 38 are pushed together.

As shown in FIGS. 1 and 2, the bath tub 2 is provided with a tank member 60 for storing warm water and a water supply/discharge device 61 which supplies or drains water to and from the tub member 2 and the tank member 60.

The warm water supply device will be explained below. A supply/discharge spout 62 is connected to a three-way valve 64 via piping 63*a*, and piping 63*b*, 63*c* which extend in the left/right as well as vertical directions. Between the vertically separated piping 63*b*, 63*c*, a pump 65 is disposed via vertically extending piping 64*d*. On the piping 63*e*, 63*f* disposed on the extension of the piping 63*b*, 63*c* is provided with another three-way valve 66, which is connected via piping 63*g* to a supply/discharge spout 67 belonging to the tub member 30. Accordingly, the three-way valves 64, 67 are operated by a control device (not shown) so as to supply/discharge warm water to and from the tank member 60. For example, when returning the warm water from the tub member 30 to the tank member 60, the warm water from the supply/discharge spout 67 takes the route shown by broken line and reaches the intake side of the pump 65 by way of piping 63*g*, the three way valve 66 and piping 63*f*, and is delivered to the tank member 60 by way of piping 63*b*, the three-way valve 64 and piping 63*a*. Conversely, when the warm water is to be supplied from the tank member 60 to the tub member 30, the warm water from the supply/discharge spout 62 takes the route shown by solid line and reaches the intake side of the pump 65 by way of piping 63*a*, the three-way valve 64 and piping 63*c*, and is delivered from the discharge side of the pump 65 to the tub member 30 by way of piping 63*e*, the three-way valve 66 and piping 63*g*.

Figure 10:
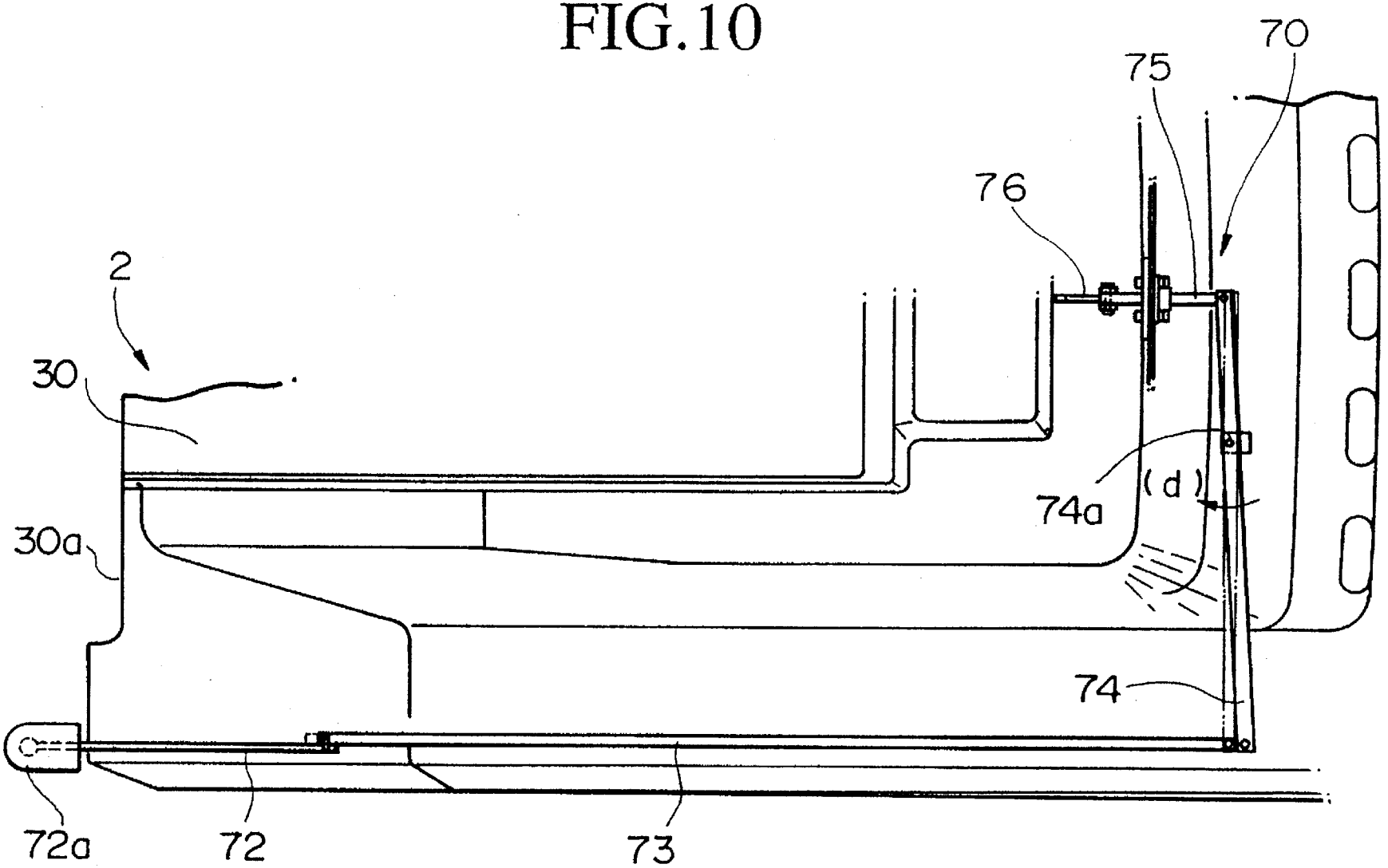
FIG. 10 is a plan view of the locking device for the wheel chair.

As shown in FIGS. 4 and 10, there is provided a chair locking device 70 for restricting the movement of the wheel chair 1 when the wheel chair 1 is positioned at a certain place within the bath tub 2.

The chair locking device 70 will be explained below. There is a foot section 72 provided at the right bottom edge of the opening section 30*a* of the tub member 30. The foot section 72*a* is attached to the end of the lower arm section of an arm 72 of an L-shape by pin fasteners in the middle portion. The end of the upper L-shaped arm 72 is connected to one end of a horizontal rod 74 by way of a connecting rod 73 which is at right angles to the horizontal rod 74, and extends horizontally along the side wall of the tub member 30. The horizontal rod is pinned at about the center thereof with a pin 74*a* to freely swing along a horizontal plane. The opposite end of the horizontal rod 74 is connected to an engaging lever 76 by way of a middle rod 75 disposed at about the center with respect to the left/right ends of the rear wall of the tub member 30. The engaging lever 76 is supported by a pin 76 so as to freely rotate in a vertical plane, and it is biased in the direction of arrow "b" shown in FIG. 4, by means of a biasing part (not shown).

The chair locking device 70 works in the following way. When the wheel chair 1 is pushed towards the back of the bath tub 2, a bar 77 provided at the rear end of the wheel chair 1 presses against the head section of the engaging lever 76, and the engaging lever 76 is rotated slightly in the direction "c" against the force of the biasing part, but is returned soon after to the original position to engage with the bar 77 to provide automatic locking. To release the wheel chair 1 from the locked position, the helper presses a little on the foot section 72*a*, and the L-shaped arm 72 rotates counter clockwise direction shown in FIG. 4. This action makes the horizontal rod 74, by way of the connecting rod 73, to rotate in the direction "d" shown in FIG. 10. The horizontal rod 74, by way of the middle rod 75, rotates the engaging lever 76 in the direction "c" in FIG. 4, and releases the engaging lever 76 from the bar 77. When the wheel chair 1 is released from locking state, it becomes free to be removed from the tub member 30.

The operation of the bathing apparatus will be explained in the following.

To use the bathing apparatus for bathing, the door unit 31 must be in an open position. The bather is placed on the wheel chair 1, and the arm 23 is raised and the foot rest 18 is pulled up at an angle. The wheel chair 1 is now pushed inside the bath tub 2. There is no impediment to this operation of pushing the wheel chair inside the bath tub 2 because the support rod 11 of the wheel chair 1 is guided along the cut-out section 37. Also, in this operation, there is no fear of wobbling of the wheel chair 1 in the left/right direction with respect to the bath tub 2, because the square pipe 16 of the chair base 10 of the wheel chair 1 is clamped from both sides with a slight spacing between them by the guide member 47 (refer to FIG. 2) disposed on the bottom section 36 of the tub member 30.

Also, the chair frame rollers 17*a* provided on the lower section of the seat section 12 of the wheel chair 1 can roll freely, from part way into the bath tub 2, on the flat section 46 provided on the protrusion sections 45*a*, 45*b* provided on the inside wall of the tub member 30, and therefore, even if there are any unevenness on the floor of the bath room, the wheel chair 1 can be wheeled into the bath tub 2 always under a constant condition. Additionally, the wheel chair 1 can be quickly placed inside the bath tub 2, because the rollers 28 provided on the lower surface of the foot rest 18 run along the bottom section 36 of the bath tub 2.

In this case, the door unit 31 is open to permit the wheel chair 1 to be wheeled inside the bath tub 2, and it is needless to say that the warm water from the bath tub 2 is to be transferred to the tank 60 prior to undertaking this phase of the operation.

When the wheel chair 1 is positioned at an appropriate position inside the bath tub 2, the chair locking device 70 operates to lock the wheel chair in position. In this condition, each of the cylinders 41 provided below the bottom section 36 of the tub member 30 are extended simultaneously so as to move the pair of bottom sealing member 38 toward each other to clamp the support rod 11 of the wheel chair 1. This operation provides sealing of the cut-out section 37 of the bottom section 36.

At the same time, the door locking device 32 is activated to close the door unit 31, each of the integral cylinders 51 provided inside the door unit 31 is extended simultaneously to press the door seal section 52*a* provided on the inside of the door unit 31 against the edges of the opening section of the tub member 30 to seal the opening section 30*a* of the tub member 30.

The tub member 30 can now be filled with warm water. This is performed by switching the three-way valves 64, 66 of the supply/discharge device 61 suitably in accordance with the signals from a control section (not shown) so as to operate the pump 65 to supply the warm water stored in the tank 60 to the tub member 30. When a suitable water level is reached, the water supply is shut off, and the bather is able to take a bath sitting in the wheel chair 1.

When the bather is exiting from the bath, a procedure opposite to the one described above is adopted.

After the supply/discharge device 61 is operated to return the the warm water from the tub member 30 to the tank 60, each of the cylinders 51 integrated into the door unit 31 and each of the cylinder 41 integrated into the bottom section 36 are contracted to deactivate their sealing action, and the door unit 31 is opened. Subsequently, the helper steps on the foot section 72*a* to release locking of the engagement lever 76 of the chair locking device 70 with the bar 77 to enable the wheel chair 1 to be pulled frontward to exit from the tub member 30.

It is permissible to provide the chair locking device 70 on the outside of the bath unit by attaching a bar 77 to a place near the back plate section 13*b* of the wheel chair 1.

In the first embodiment, the sealing of the cut-out section 37 of the bottom section 36 in the tub member 30 was carried out by clamping the support rod 11 from both left and right sides with the bottom sealing members 38. However, the present invention is not limited to this configuration, and other methods of sealing can also be used. For example, the bottom sealing members 38 can be provided above the bottom section 36, or the support rod 11 can be clamped from front and rear directions.

Also, in the first embodiment, the movement of the bottom sealing members 38 was carried out by hydraulic cylinders 41, however, it is not necessary to limit to this type of motive power. For example, electrical motors and other driving methods can be used equally well. The same applies to the cylinders integrated into the door unit 31.

Furthermore, in the first embodiment, the sealing member 51*a* was provided on the door unit 31, but it is also permissible to provide such a sealing member on the tub member 30.

Figure 11:
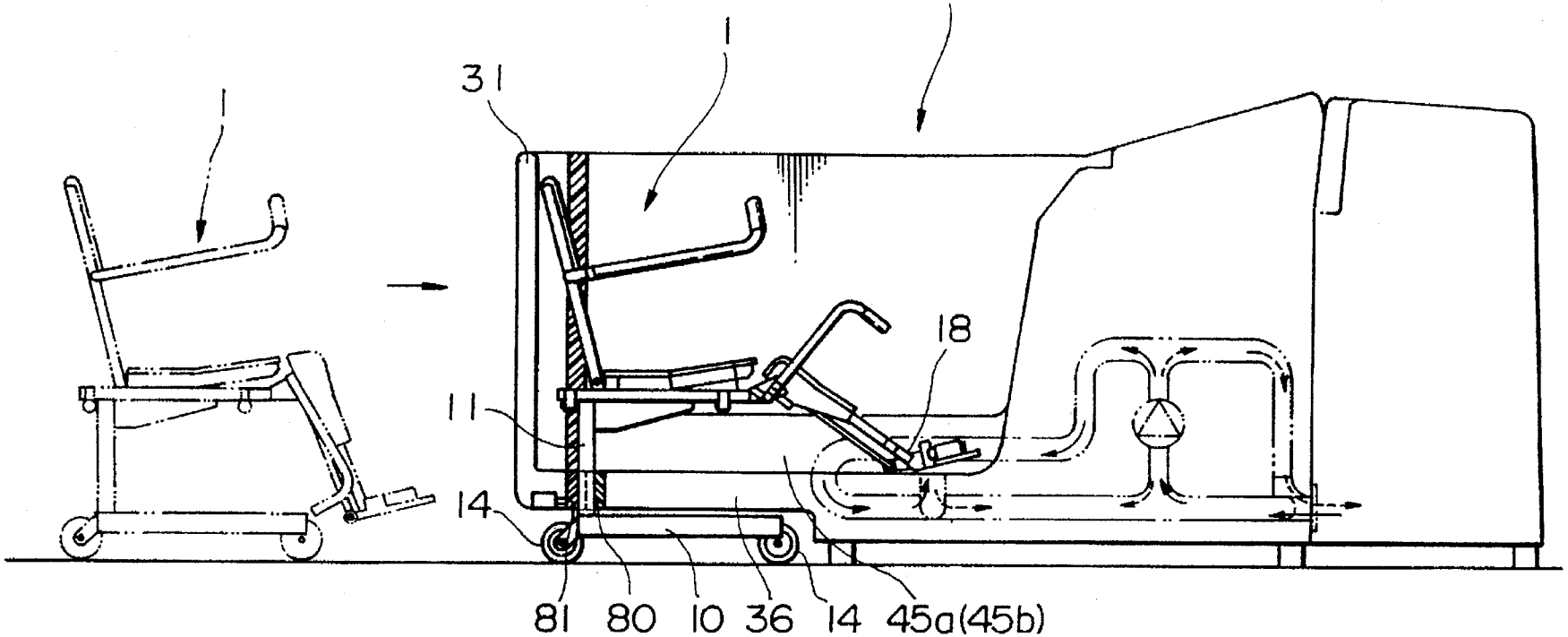
FIG. 11 is a cross sectional side view of a second embodiment of the bathing apparatus of the present invention.
Figure 12:
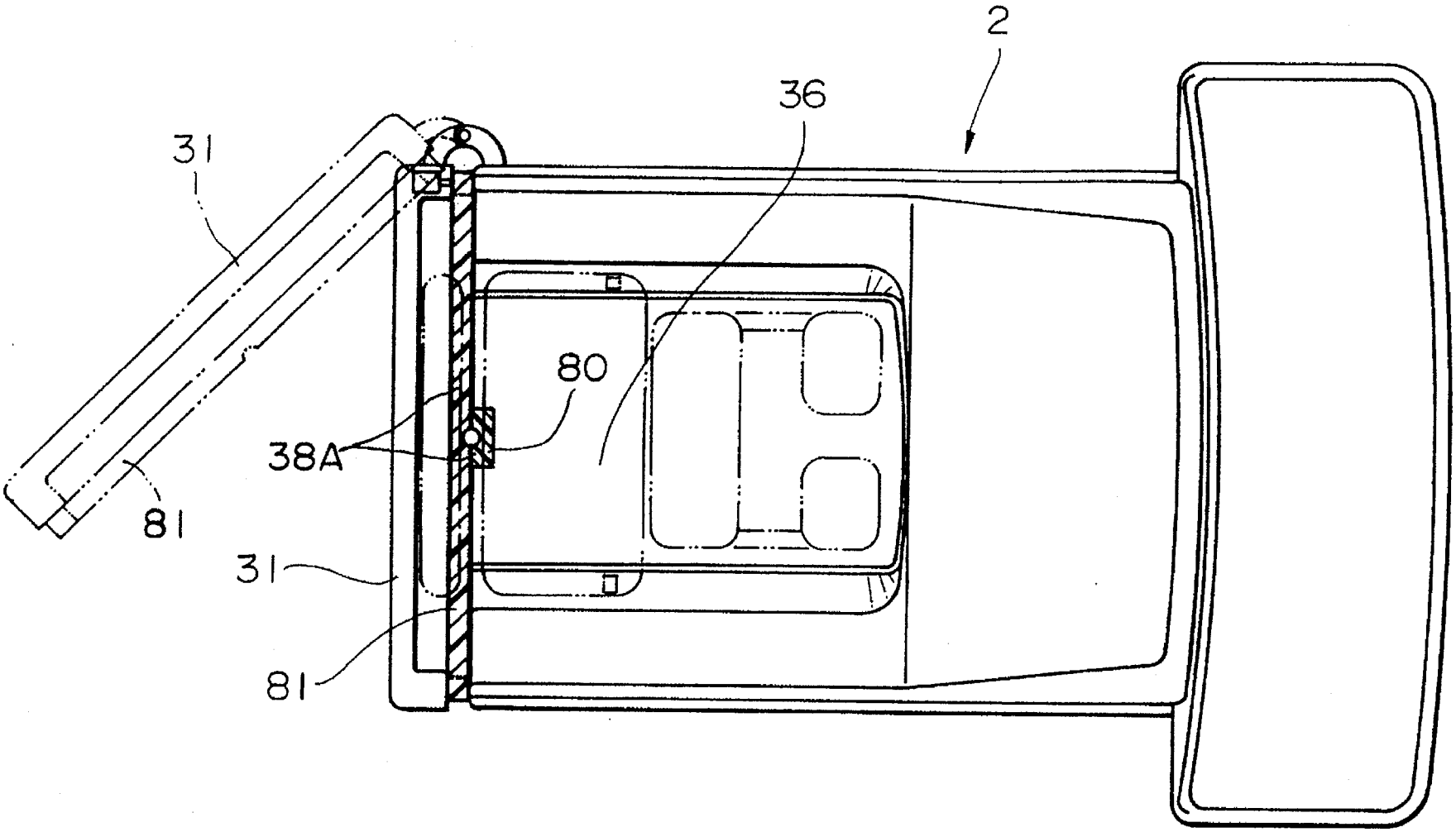
FIG. 12 is a plan view of the bathing apparatus of the second embodiment.
Figure 13:
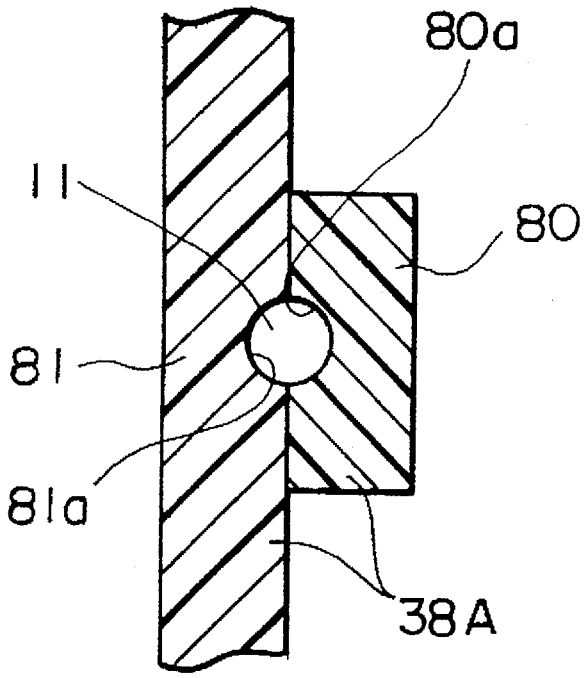
FIG. 13 is an enlarged cross sectional view of the sealing device of the second embodiment.

A second embodiment is illustrated in FIGS. 11 to 13.

In the first embodiment, the bather faces front of the bath tub 2 and the back rest of the wheel chair 1 was in the leading position. In the second embodiment, the bather faces the rear of the bath tub 2, and the foot rest of the wheel chair 1 is in the leading position.

As shown in these Figures, the difference between the structures of the bathing apparatuses of the first and second embodiments is that the interface between the door and the bottom section 36 of the bath tub 2 is provided with the sealing device 38A comprising sealing members 80, 81 having a semi-circular depressions 80*a*, 81*a* to correspond with the shape of the support rod 11.

In the second embodiment also, the same benefits as in the first embodiment are obtained, i.e., the bather seated on the wheel chair 1 is able to take a bath without the caster rollers 14 of the wheel chair 1 being introduced into the tub member 30, and furthermore, there is no need to have a sloping pathway to the bath tub 2.

In the second embodiment, it is necessary to reduce the dimensions of the protrusion sections 45*a*, 45*b* provided on the inside of the tub member 30 so as not to interfere with the foot rest 18. Therefore, the saving in the amount of warm water used to fill the tub member 30 is less than in the first embodiment.

Figure 14:
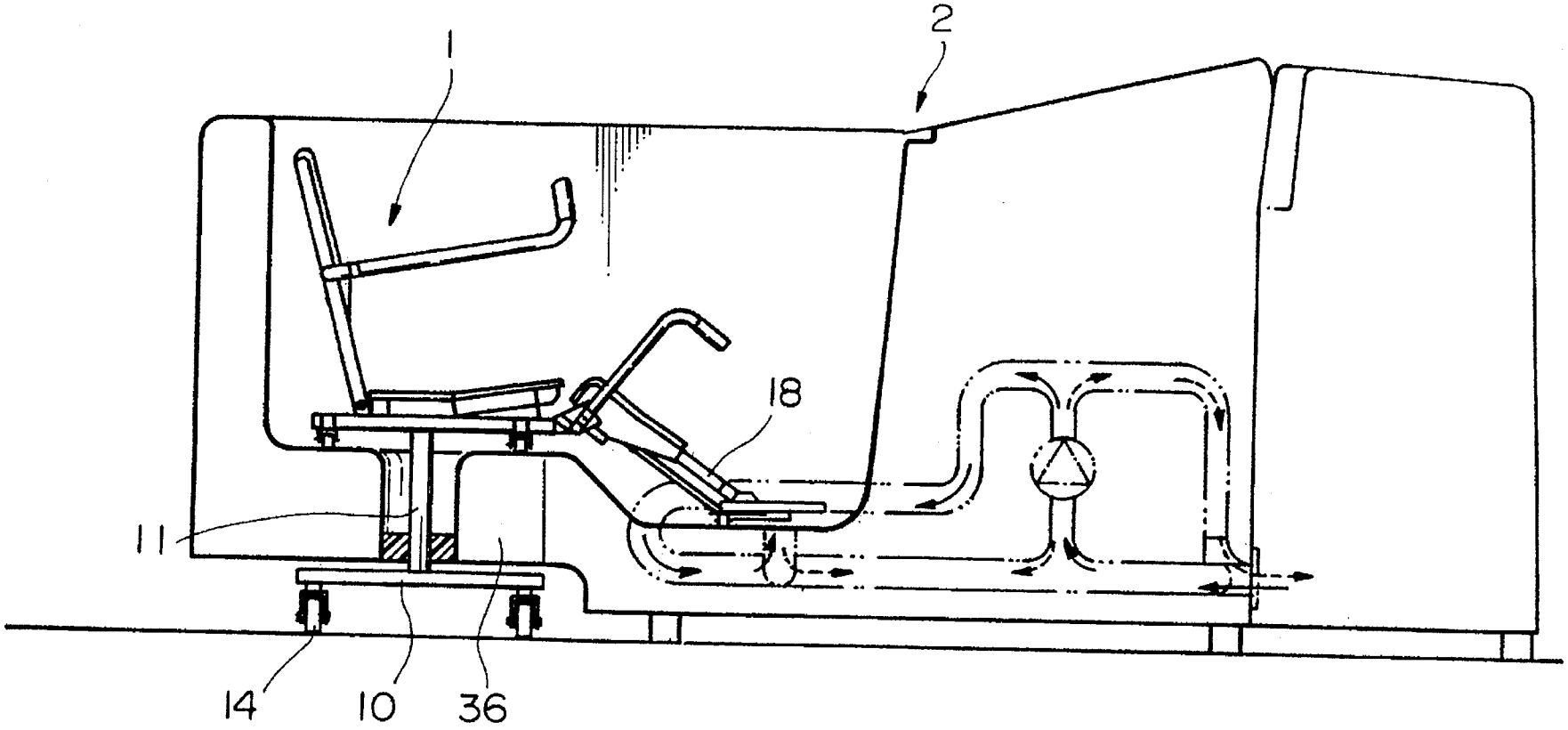
FIG. 14 is a cross sectional side view of a third embodiment of the bathing apparatus of the present invention.
Figure 15:
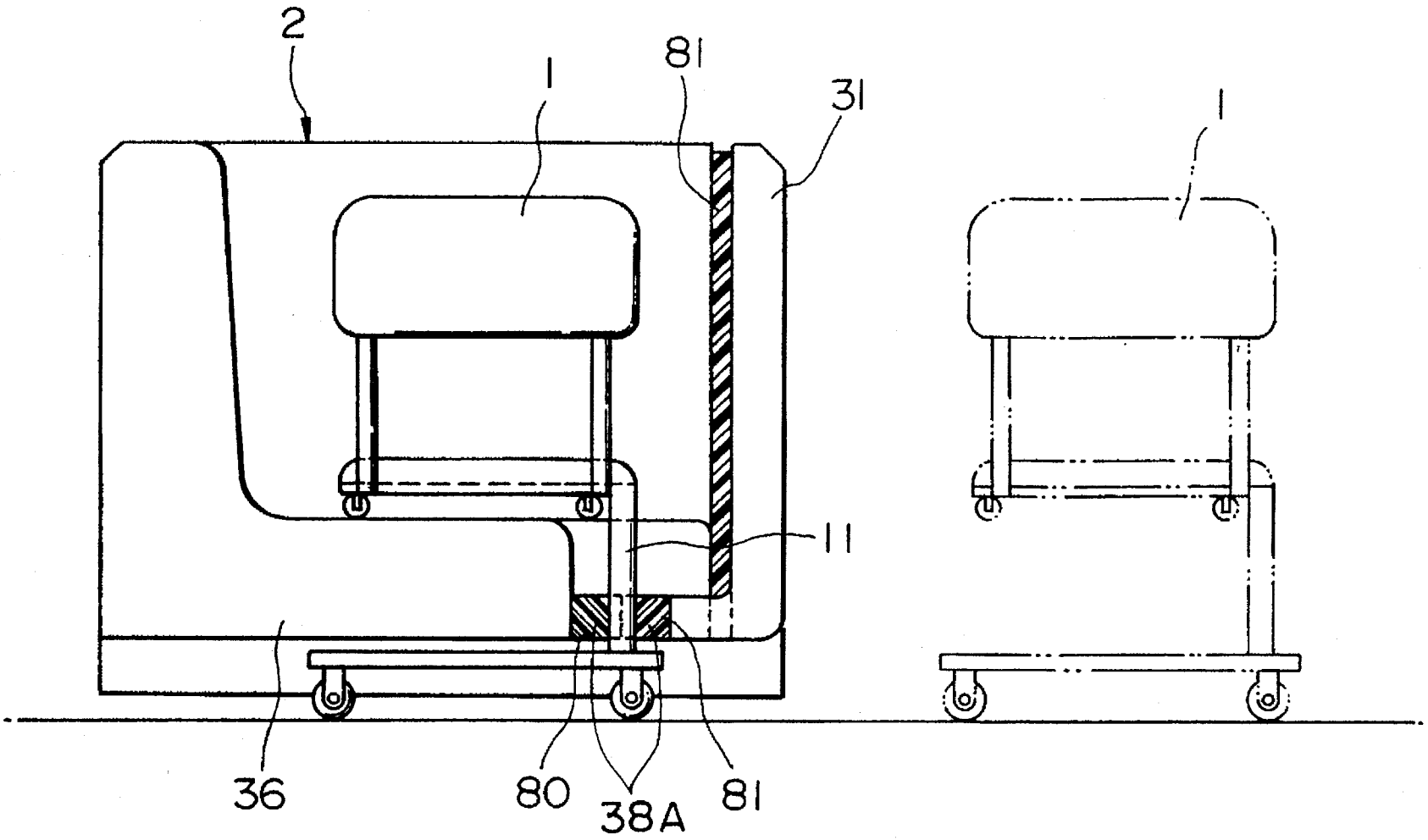
FIG. 15 is a cross sectional front view of the third embodiment.
Figure 16:
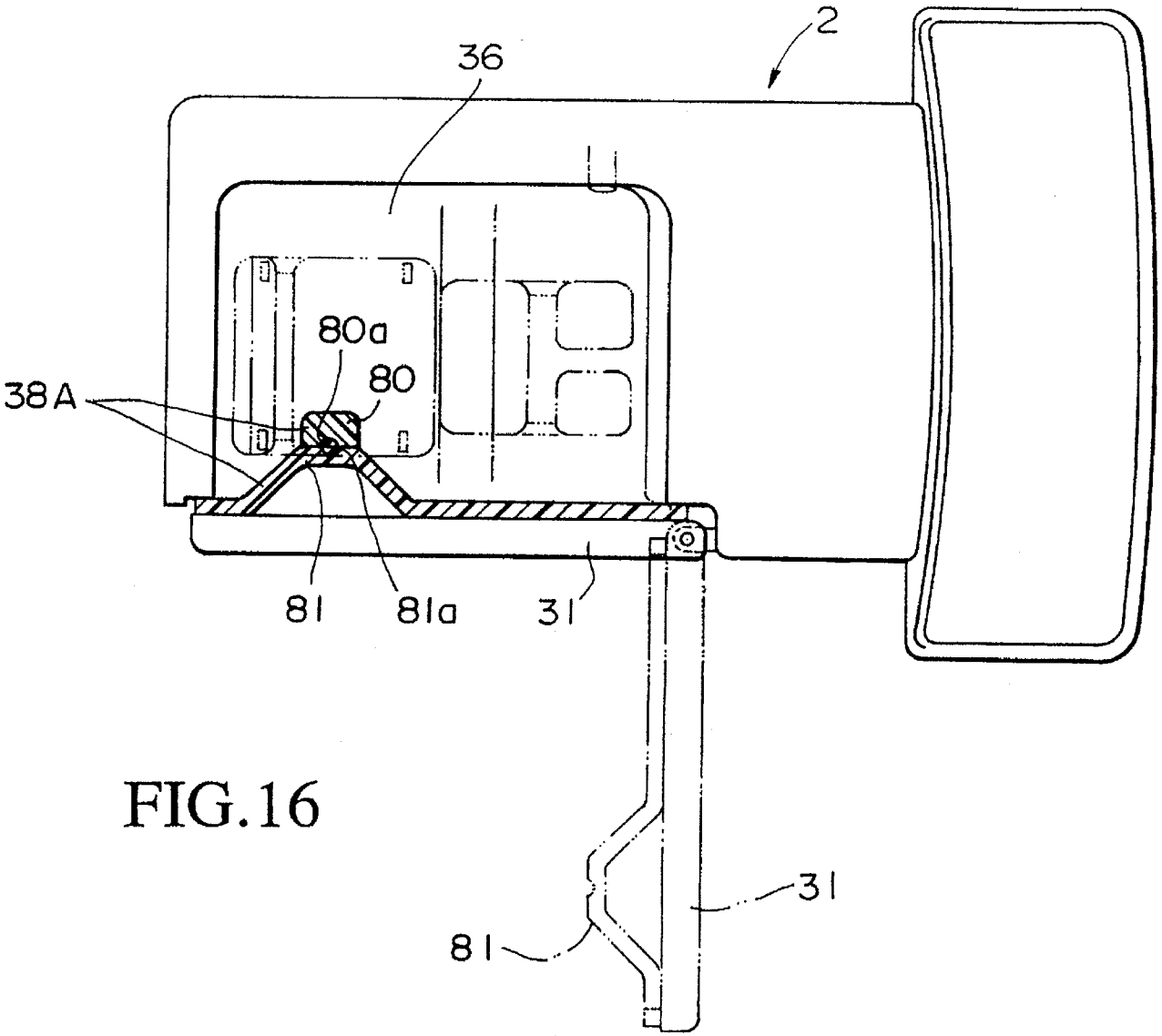
FIG. 16 is a plan view of the third embodiment.

FIGS. 14 to 16 illustrate a third embodiment.

The feature of the bathing apparatus of this embodiment is the provision of an opening section and a door unit 31 for closing the opening section on the side wall of the bath tub 2 to enable the wheel chair 1 to be introduced into the tub member 30 through the side entrance.

In the third embodiment also, there is a sealing device 38A comprising sealing members 80, 81, is provided at the interface between the bottom section 36 of the bath tub 2 and the door unit 31 for clamping the support rod 11 from both sides for sealing the contact area therebetween. Also, each of the sealing members 80, 81 is provided with a semi-circular depressions 80*a*, 81*a* as in the second embodiment. The support rod 11 is provided on the side edge of the wheel chair 1 facing the side wall of the bath tub 2.

The bathing apparatus of the third embodiment also provides the same benefits described for the first and second embodiment.

What is claimed is:

1. A door-equipped bathing apparatus comprising:

a wheel chair provided with a chair base having caster rollers, a support rod fixedly erected on said chair base, and a seat section firmly supported on a free end of said support rod; and a bath tub provided with a bottom section having a bottom sealing device for allowing said support rod to pass through said bottom section and providing water-tight sealing around said support rod which passes through said bottom section of said bath tub;

wherein an opening section formed on a vertical section of said bath tub provides entry of said wheel chair through said opening section thereinto, such that said support rod passes through said bottom section of said bath tub while said seat section is inside said tub and said caster rollers are located externally of said tub.

2. A door-equipped bathing apparatus as claimed in claim 1, wherein said bath tub is provided with a tank for storing warm bath water and a supply/discharge device for supplying warm water from said tank to, and removing the warm water from, said tub.

3. A door-equipped bathing apparatus as claimed in claim 2, wherein said bottom sealing device comprises a cut-out section which extends from said opening section into an interior portion of said bath tub for allowing an intrusion of said support rod in said cut-out section and includes a pair of bottom section sealing members disposed adjacent to said cut-out section for providing a water-tight sealing of said tub by clamping said support rod positioned in said cut-out section therebetween.

4. A door-equipped bathing apparatus as claimed in claim 3, wherein said pair of bottom sealing members are disposed to move freely towards or away from each other by means of hydraulic cylinders integrally provided with said bath tub.

5. A door-equipped bathing apparatus as claimed in claim 4, wherein said support rod is the one and only support rod.

6. A door-equipped bathing apparatus as claimed in claim 5, wherein there is provided a door seal section between said bath tub and a door unit connected to said tub at said opening section.

7. A door-equipped bathing apparatus as claimed in claim 6, wherein said door unit comprises a main door member and said door seal section is provided on said main door member and comprises a protruding door sealing part which protrudes towards said tub and contacts said pair of bottom sealing members when said door is in a closed position against said tub.

8. A door-equipped bathing apparatus as claimed in claim 7, wherein said door seal section is disposed to move freely towards and away from said door unit by means of hydraulic cylinders provided integrally with said door unit.

9. A door-equipped bathing apparatus as claimed in claim 8, wherein chair frame rollers are provided below said seat section of said wheel chair, and interior surfaces of said tub comprise protrusion sections each formed with a flat section for supporting said chair frame rollers.

10. A door-equipped bathing apparatus as claimed in claim 9, further comprising a chair locking device for restricting the movement of said wheel chair when said wheel chair is positioned at a certain place within said tub.

11. A door-equipped bathing apparatus as claimed in claim 3, wherein there is provided a door seal section in a region where said tub opposes a door unit connected to said tub at said opening section.

12. A door-equipped bathing apparatus as claimed in claim 11, wherein said door unit comprises a main door member and said door seal section is provided on said main door member and comprises a protruding door sealing part protruding towards said tub to abut said pair of bottom sealing members when said door is in a closed position against said tub.

13. A door-equipped bathing apparatus as claimed in claim 12, wherein said door seal section is disposed to move freely towards or away from said main door member by means of hydraulic cylinders integrally provided with said main door member.

14. A door-equipped bathing apparatus as claimed in claim 1, wherein said caster rollers are adapted to contact the ground on which said tub rests when said wheel chair is positioned inside said tub.

* * * * *